US006206384B1

(12) United States Patent
Chi et al.

(10) Patent No.: US 6,206,384 B1
(45) Date of Patent: Mar. 27, 2001

(54) DOLL WALKER WITH ACTIVITY TOY

(75) Inventors: Kam Mang Chi, Aberdeen; Chiang Chi Wing, Kowloon, both of (HK)

(73) Assignee: Unimax Toys Ltd., Hong Kong (HK)

( * ) Notice: Subject to any disclaimer, the term of this patent is extended or adjusted under 35 U.S.C. 154(b) by 0 days.

(21) Appl. No.: 09/241,210

(22) Filed: Feb. 1, 1999

(51) Int. Cl.[7] ..... B62B 7/12
(52) U.S. Cl. ..... 280/30; 280/643; 280/47.2
(58) Field of Search ..... 280/1.23, 30, 31, 280/642, 643, 47.18, 47.2, 47.25, 47.26, 47.38; 446/71, 227, 451

(56) References Cited

U.S. PATENT DOCUMENTS

| | | | | |
|---|---|---|---|---|
| D. 293,227 | * | 12/1987 | McElhaney | 446/227 |
| 3,577,675 | * | 5/1971 | Kohner | 446/227 |
| 4,664,396 | * | 5/1987 | Pietrafesa | 280/47.38 |
| 4,865,337 | * | 9/1989 | Disler et al. | 280/47.18 |
| 4,872,692 | * | 10/1989 | Steenburg | 280/643 |
| 4,963,115 | * | 10/1990 | Stowell et al. | 280/30 |
| 5,362,272 | * | 11/1994 | Chow et al. | 280/47.38 |
| 5,441,289 | * | 8/1995 | Spielberger | 446/451 |
| 5,454,745 | | 10/1995 | Spielberger | 446/71 |
| 5,474,483 | * | 12/1995 | Sun | 446/71 |
| 5,503,411 | * | 4/1996 | Sundberg et al. | 280/30 |
| 5,788,253 | * | 8/1998 | Thomson et al. | 280/47.38 |
| 6,089,666 | * | 7/2000 | Rosko | 280/47.38 |

FOREIGN PATENT DOCUMENTS

| | | | | |
|---|---|---|---|---|
| 92/12884 | * | 8/1992 | (WO) | 280/643 |

* cited by examiner

*Primary Examiner*—Frank Vanaman
(74) *Attorney, Agent, or Firm*—Larry L. Saret; Laff, Whitesel & Saret, Ltd.

(57) ABSTRACT

A toy convertible between a doll walker and an activity play board includes a base having at least one wheel, and activity components and a seat formed in a first main surface of the base. A pair of bosses project laterally from the sides of the base, and a pair of wheeled legs attach to the base by engaging the bosses in boss cavities and with a fastener. By selecting the appropriate boss cavities, the base can be either horizontally oriented or inclined relative to the horizontal.

12 Claims, 8 Drawing Sheets

DOLL WALKER WITH ACTIVITY TOY

This invention relates to activity play toys and, more particularly, to a toy that can function as both a walker for a doll and a activity play board.

Typical walkers for dolls have limited play value. They are often merely scaled-down versions of real baby walkers and include a seat, several wheels under the seat and a handle mounted to the seat. A doll is placed in the seat and then a child pushes the walker with the doll around the house or outdoors. When the doll is removed from the walker, the walker ceases to have play value.

Activity play boards are also known, on which are mounted various buttons, spinners, handles, horns, and similar amusing features. These activity play boards are generally fun for a very young child, but as the child grows older, the child typically loses interest and the activity play board ceases to be used.

As any parent knows, toys in general consume enormous amounts of space. In a small apartment or home, space is a limited and precious commodity. Toys that possess extensive play value, particularly to children of different ages, are unusual and few in number.

Thus, there is a need for a doll walker that provides play value even when a doll is removed from it. Further, there is a need for a activity play toy that will retain interest for a child as the child ages over an extended time period, or for children of different ages.

SUMMARY OF THE INVENTION

Accordingly, an object of the invention is to provide a doll walker that also functions as a activity play board. A further object is to provide a toy that is easily convertible from one toy to another.

According to the present invention, the foregoing and other objects and advantages are attained by a toy that includes a base having a first main surface and two sides spaced apart by the first main surface, a handle extending from one end of the base, a pair of legs removably mounted to the sides, each leg having a wheel, at least one other wheel mounted to the base near an end opposite from the handle, a seat formed in the base, and activity components provided in the base. The base further includes a pair of bosses, each boss projecting laterally from a side of the base. The legs each further include first and second boss cavities, the first boss cavity angularly oriented relative to the longitudinal axis of the leg differently than the second boss cavity. The boss cavities are sized to firmly engage the bosses and to resist rotation about the bosses. By selectively securing the legs to the base using either the first or second boss cavities, the base can by oriented in either a generally horizontal position—which is suitable for playing with the activity components—or a position inclined relative to the horizontal—which is suitable for using the invention as a doll walker. Still other objects, advantages and novel aspects of the present invention will become apparent in the detailed description of the invention that follows, in which the preferred embodiment of the invention is shown by way of illustration and by reference to the attached drawings.

DETAILED DESCRIPTION OF THE PREFERRED EMBODIMENT

Figure 1:
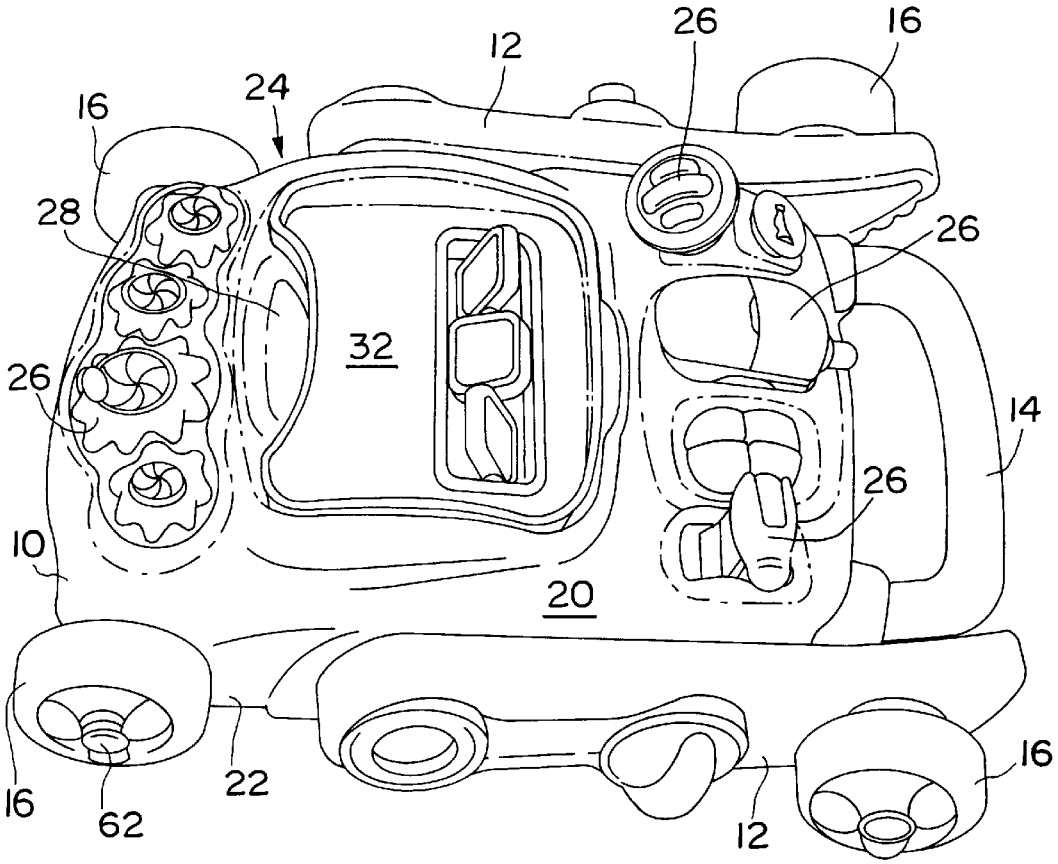
FIG. 1 is a perspective view of the invention in a generally horizontal position.
Figure 2:
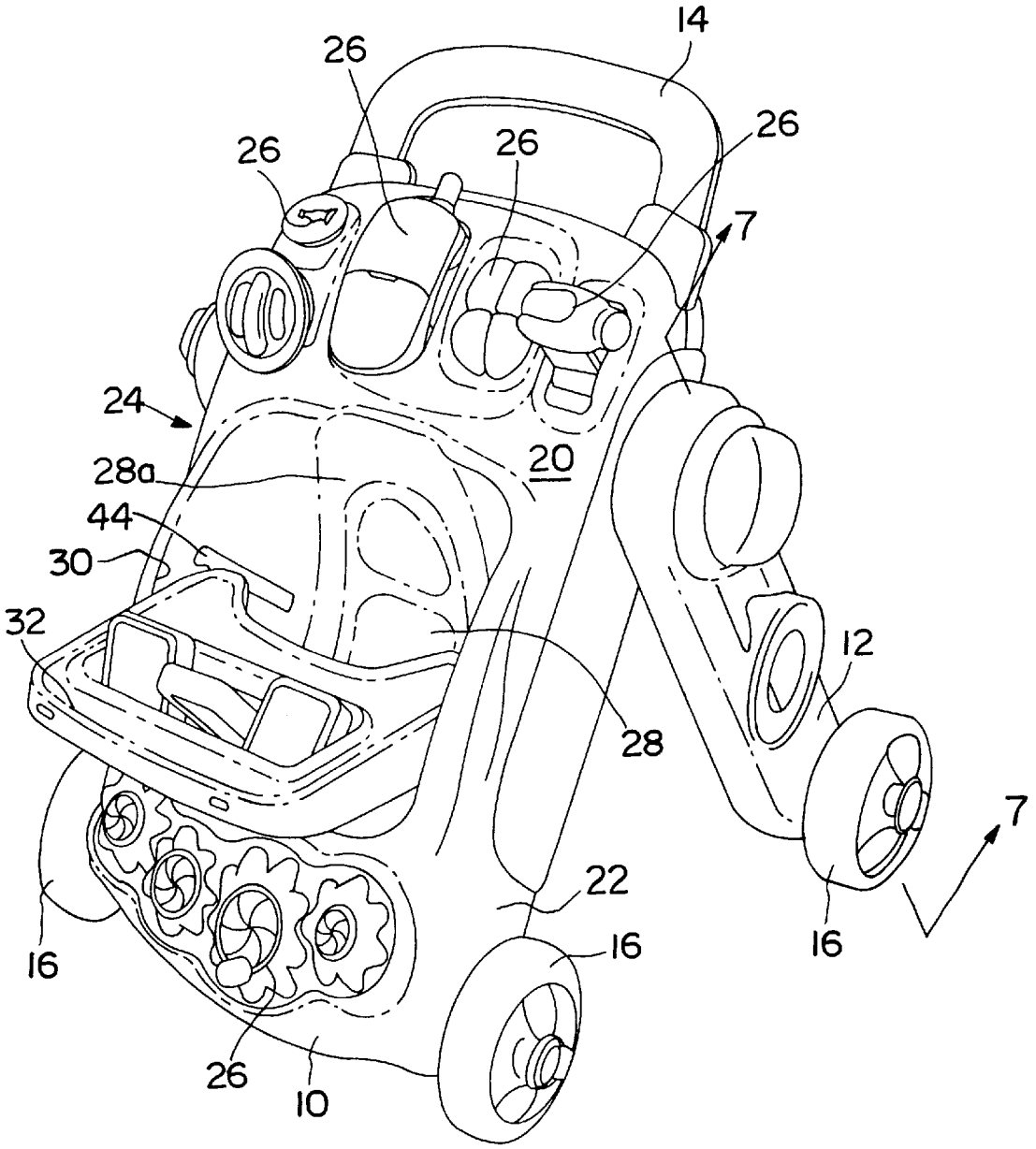
FIG. 2 is a perspective view of the invention inclined so as to be operable as a doll walker.

As shown in FIGS. 1 and 2, the invention includes a base 10, a pair of legs 12, a handle 14, and four wheels 16. The base is generally rectangular, although other shapes could be used. Two of the wheels are positioned near the front comers of the base, while the other two wheels are located at the ends of the legs. If desired, the two front wheels could be replaced by a single wheel positioned near the front and middle of the base, resulting in a three-wheeled walker.

The base includes a top or first main surface 20 and two longitudinal sides 22, 24. Preferably, a wheel mounting 62 projects outwardly from each of the front two comers of the longitudinal sides 22, 24, and a wheel 16 is rotatably fixed to each mounting 62. The base also includes a plurality of activity features or components 26, which may take various forms but generally comprise buttons, handles, horns, gears, toy telephone, and various other amusement devices suitable for a very young child. These activity components 26 are accessible to a child from the first main surface 20. The base further includes a doll seat 28 built into a well 30 located in the first main surface 20. A tray 32 is pivotally mounted to the base 10 and within the well 30 so that the tray partially conceals the seat 28 when the base is oriented horizontally (FIG. 1). The tray rotates to extend generally perpendicularly to the seat back 28*a* when the base is angled relative to the horizontal (FIG. 2).

Figure 8:
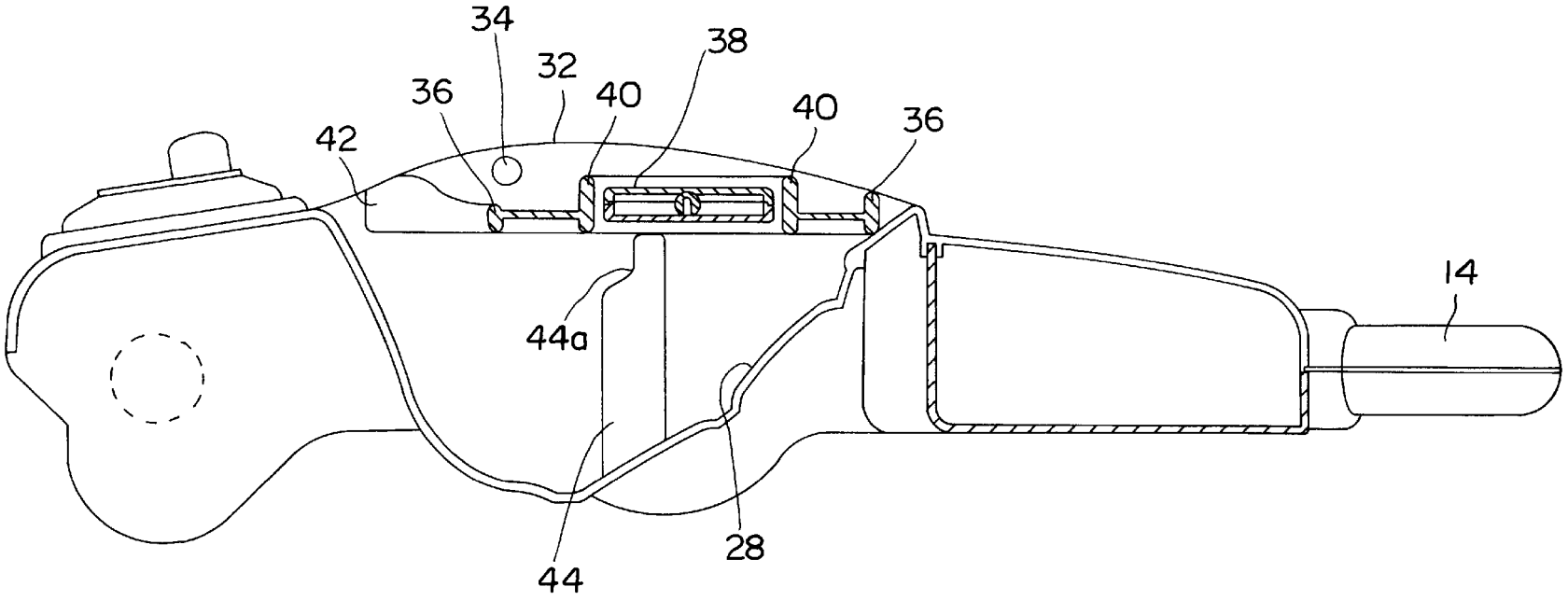
FIG. 8 is a cross-sectional view of the invention in a generally horizontal position.
Figure 9:
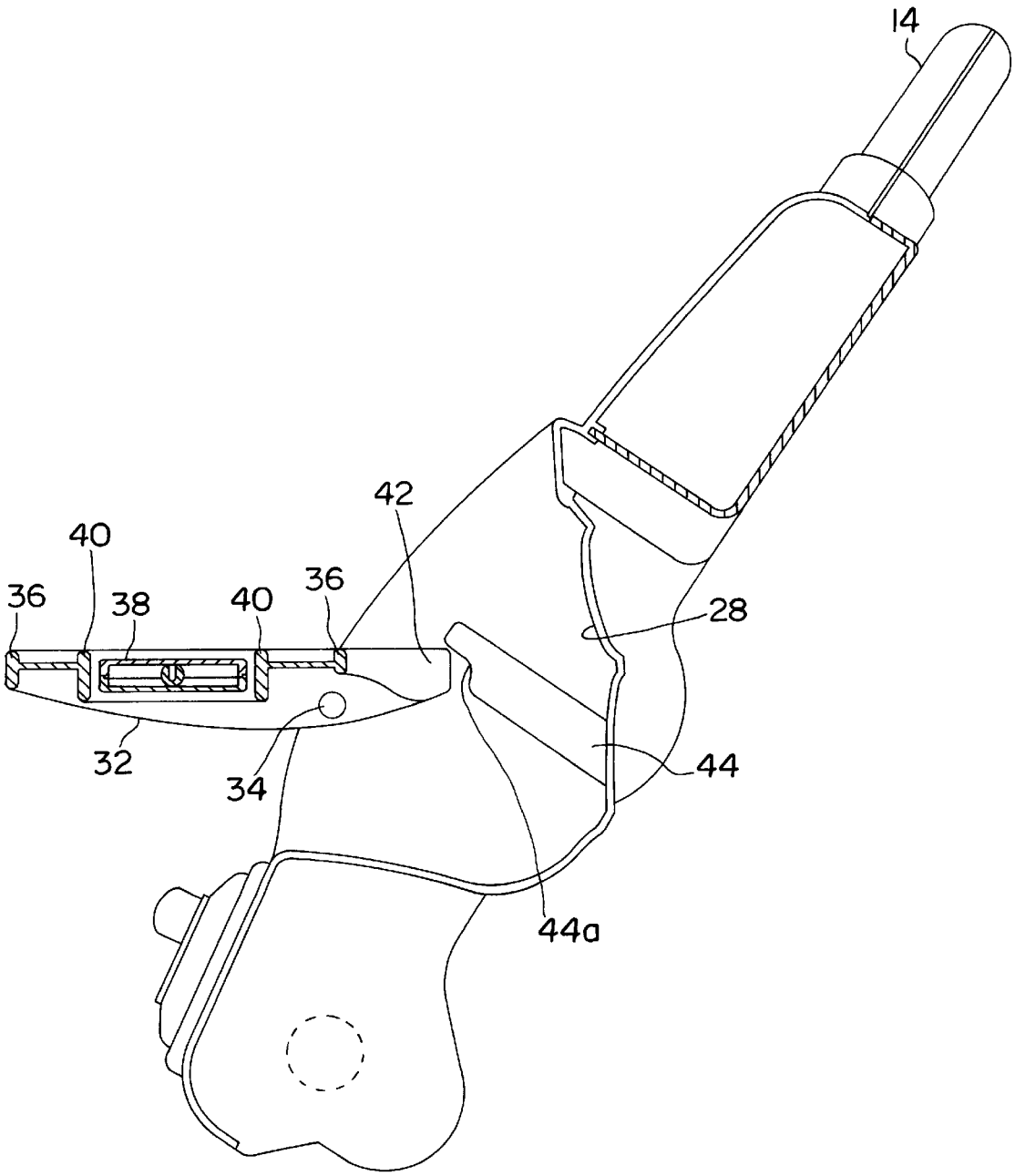
FIG. 9 is a cross-sectional view of the invention inclined so as to be operable as a doll walker.

The tray 32 is shown in more detail in FIGS. 8 and 9. Tray 32 pivots or rotates about tray rod 34, which bridges well 30 laterally across seat 28. An outer lip 36 extends around the periphery of the tray to help retain any items placed on the tray, such as doll accessories. In the approximate center of the tray are a plurality of spinning toys 38, which in turn are surrounded by an inner lip 40. The inner lip 40 works with the outer lip 36 to retain any items placed on the tray. When the tray is pivoted in a counter-clockwise direction from the first position shown in FIG. 8 to the second position shown in FIG. 9, the ears 42 of the tray each catch upon a notch 44*a* of a ledge 44 formed within the well to limit movement of the tray so that it is oriented generally perpendicularly to the seat back 28*a*. A space then exists between tray 32 and seat 28 to permit a doll or the like to be seated therein.

As best shown in FIGS. 3–7, the legs 12 attach to and support the base 10 in at least two positions. When the invention is positioned generally horizontally (FIG. 3), the legs 12 are likewise in a generally horizontal position, so that the longitudinal axes of the legs are parallel to the longitudinal axis of the base. When the invention is to used as a doll walker (FIG. 4), the legs are connected to the base so that the handle end 10*a* of the base is above the opposite end 10*b* of the base, and the legs are also inclined to the horizontal.

Figure 6:
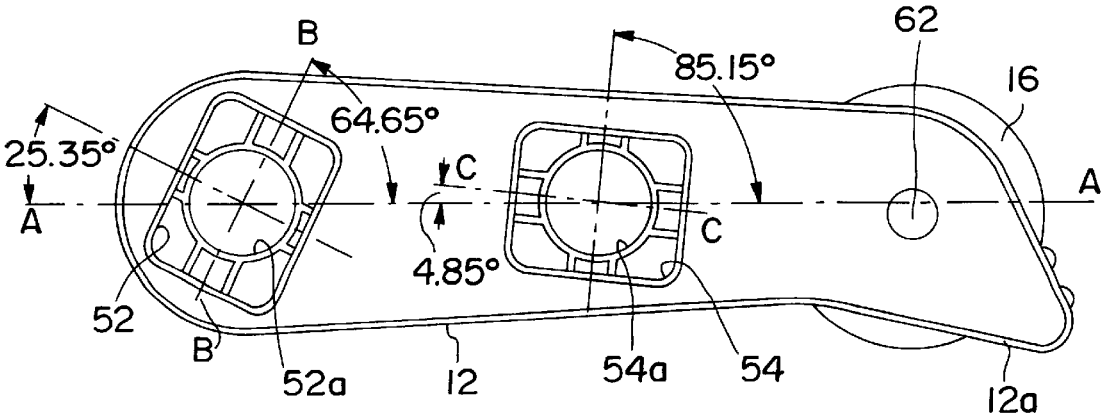
FIG. 6 is an elevation view of a leg of the invention.

The base 10 includes a pair of bosses 50 projecting laterally outwardly, one boss 50 from each side 22 of the base. Each boss has a central aperture 50*a* which is preferably threaded. At least two mating boss cavities—first boss cavity 52 and second boss cavity 54—are included on each leg 12 (FIG. 6). Each boss cavity corresponds to the shape of a boss 50 and can receive a boss in a firmly conforming, non-rotatable connection. The boss cavities each define a central aperture, shown as 52*a* for first boss cavity 52 and as 54*a* for second boss cavity 54. First and second boss cavities 52, 54 each have a different angular orientation relative to the longitudinal axis A of the leg. For example, as shown in FIG. 6, the longitudinal axis B of first boss cavity 52 is approximately 65 degrees from the longitudinal axis A of leg 12, while the longitudinal axis C of second boss cavity 54 is approximately 5 degrees from the longitudinal axis A of leg 12. By securing the legs 12 to bosses 50 using boss cavities 54, the invention is positioned generally horizontally. By securing legs 12 to bosses 50 using boss cavities 52, the base and legs are inclined to the horizontal. Other angular orientations of the boss cavities could be used to achieve other inclinations for the base. Nevertheless, the two first boss cavities on legs 12 have a common angular orientation, and the two second boss cavities on legs 12 also have a common angular orientation. If more than two inclination positions are desired for the base, more than two boss cavities can be provided for each leg.

Figure 7:
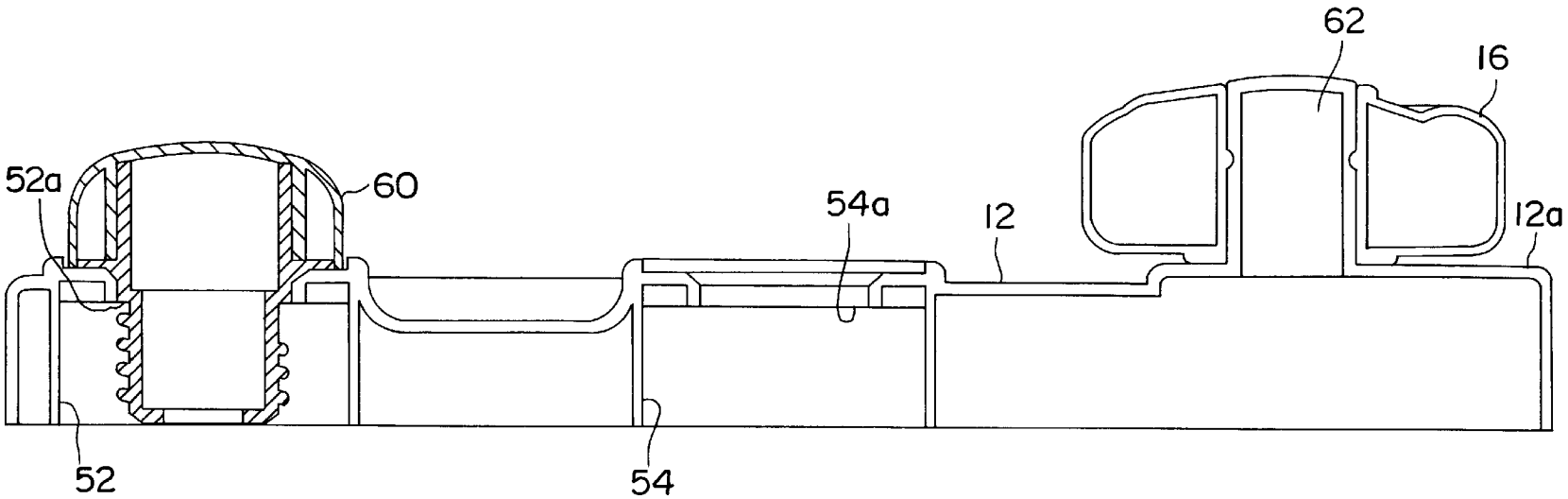
FIG. 7 is cross-sectional view of a leg of the invention.

A fastener 60, preferably a threaded fastener, is used to lock each leg through a selected boss cavity to a boss 50, where the threads 60*a* engage the threads 50*b*. The bosses 50 are coaxially aligned, so that when the fasteners 60 are threaded through either first boss cavities 52 or second boss cavities 54 to secure the legs 12 to the sides 22 of the base, the legs are positioned evenly relative to each other and to the sides 22. A wheel 16 is rotatably mounted on a wheel mounting 62 at a terminal end 12*a* of each leg 12, with the wheel mountings 62 oriented perpendicularly to the longitudinal axis of the leg (FIG. 7). The wheel 16 and boss cavities 52, 54 are preferably linearly aligned along each leg. When the invention is in a horizontal position (FIG. 1), the wheels 16 mounted on wheel mountings 62 space the bottom of the base above the underlying surface to permit easy rolling movement of the entire device.

Alternatively, the fastener could be avoided by forming the bosses and boss cavities so that there is a tight frictional engagement between them.

Figure 3:
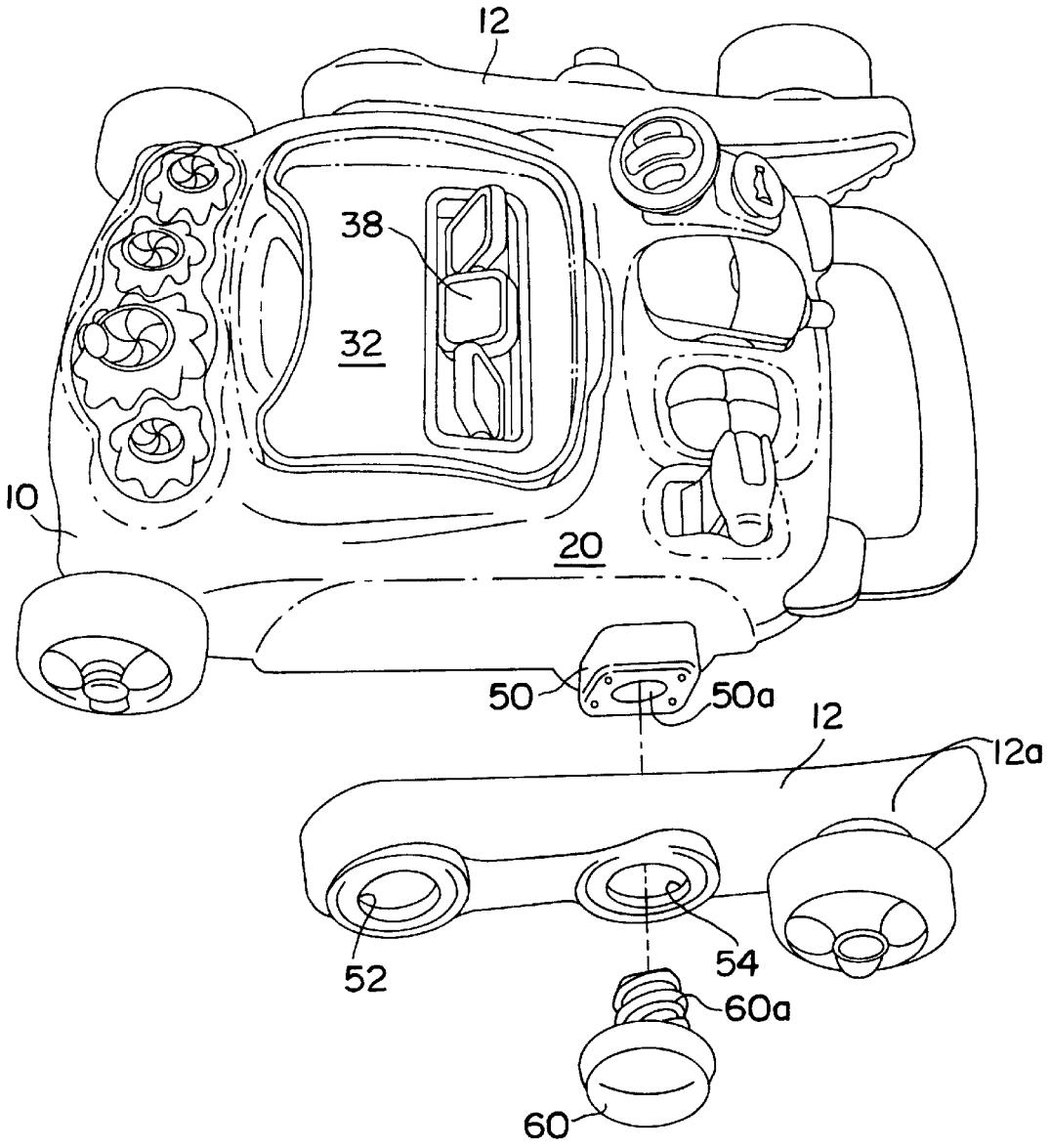
FIG. 3 is a partially exploded view of the invention showing attachment of a leg for use as a activity play board.

To use the invention as an activity play board, the legs 12 are preferably positioned so that their longitudinal axes are in a generally horizontal orientation. As shown in FIG. 3, for each leg a fastener 60 is inserted first into boss cavity 54 and finally threaded into boss cavity 50*a*. With this orientation of the legs 12, the top or first main surface 20 faces upwardly, permitting easy access to and use of the activity components 26. The folding tray 32 is also pivoted to a position generally parallel to the first main surface 20, so that spinning toys 38 are likewise easily accessible.

Figure 4:
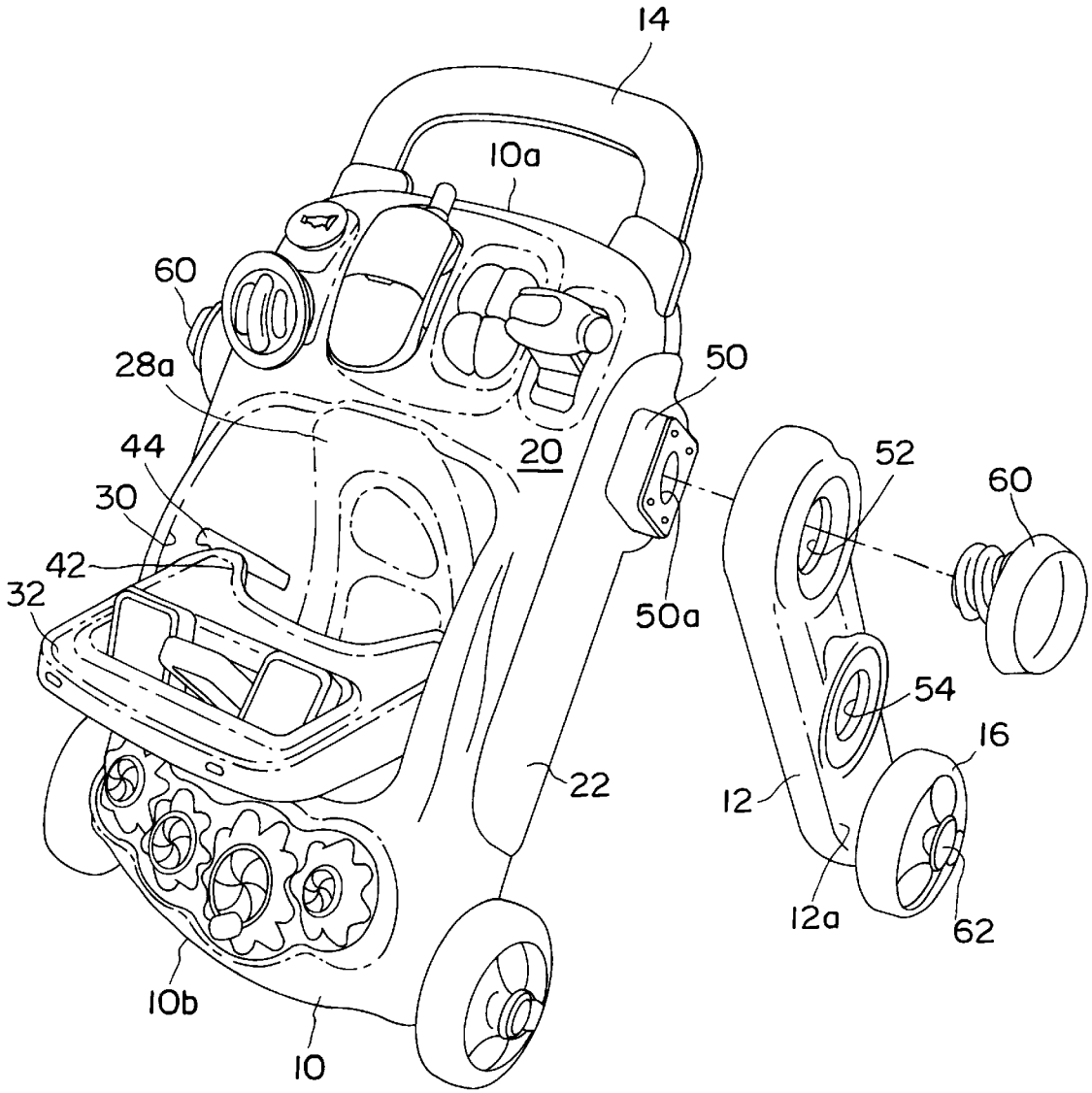
FIG. 4 is a partially exploded view of the invention showing attachment of a leg for use as a doll walker.
Figure 5:
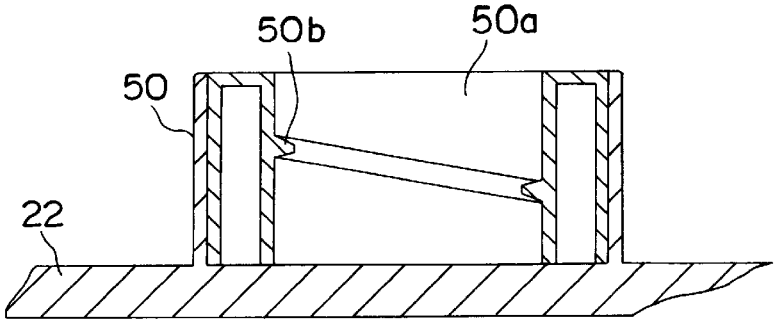
FIG. 5 is cross-sectional view of a boss projecting from a side of the base of the invention.

To use the invention as a doll walker, the legs 12 are preferably positioned so that their longitudinal axes are angled relative to the horizontal. As shown in FIG. 4, for each leg a fastener 60 is inserted first into boss cavity 52 and finally threaded into boss 50*a*. With this orientation of the legs 12, first main surface 20 is inclined relative to the horizontal. The tray 32 is pivoted so that it is generally parallel to the horizontal and perpendicular to seat back 28*a*. The handle 14 permits a user to push the invention along wheels 16.

Desirably, the invention is molded of any suitable plastic.

Thus, the invention provides the advantages of two toys, is easily convertible from one toy to the other, and appeals to children of the same or different ages. While the present invention has been described with reference to a preferred embodiment thereof, illustrated in the accompanying drawings, various changes and modifications can be made by those skilled in the art without departing from the spirit and scope of the present invention. For example, the bosses could be formed on the legs while the boss cavities could be formed on the base. Therefore, the following claims are to be construed to cover equivalent structures.

The invention claimed is:

1. A toy that functions as either a doll walker or activity play toy, comprising:

a. a base, said base having a first main surface and two sides spaced apart by said first main surface;

b. a pair of legs, each leg having a longitudinal axis and removably mounted to one of said sides;

c. at least three wheels, one wheel rotatably mounted to each leg, the remainder of said at least three wheels rotatably mounted to said base;

d. a seat and activity components formed in said base;

e. a pair of bosses, one boss projecting laterally from each side of said base;

f. each leg having a first boss cavity and a second boss cavity, each boss cavity conforming to an exterior of one of said bosses, each said first boss cavity having a different angular orientation relative to said longitudinal axis of said leg than each said second boss cavity, said two first boss cavities on said legs having a common angular orientation and said two second boss cavities on said legs having a common angular orientation;

wherein said legs are connected to said base by the engagement between said bosses and a selected pair of said first or second boss cavities, the choice of boss cavities determining the angular inclination of said base in either of two positions.

2. The toy of claim 1 further including a fastener for removably locking each of said legs to a side of said base.

3. The toy of claim 2 wherein said fastener is threaded, each of said boss cavities has an aperture permitting passage of said threaded fastener, and each of said bosses has a threaded receptacle for engaging the threads of said fastener.

4. The toy of claim 1 further including a tray pivotally mounted to said base and spaced apart from said seat.

5. The toy of claim 4 wherein said base includes a well formed in said first main surface, and wherein said seat is in said well and said tray extends across a top of said well.

6. The toy of claim 1 further including means for pushing said base.

7. The toy of claim 1 wherein said legs and base each have a longitudinal axis, and wherein said longitudinal axes are generally parallel to each other when said legs are connected to said base using said two second boss cavities.

8. The toy of claim 1 wherein said legs each have a terminal end, and wherein said one wheel rotatably mounted to each leg is located at said terminal end.

9. The toy of claim 8 wherein said first and second boss cavities and said one wheel mounted to each leg are linearly aligned along each leg.

10. The toy of claim 1 wherein said base has two wheels rotatably mounted thereto.

11. The toy of claim 1 wherein said base has a front and a back, and wherein said back is inclined above said front when said legs are connected to said base using said two first boss cavities.

12. A toy convertible between a doll walker and an activity play board, comprising:

a base, said base having a first main surface and two sides spaced apart by said first main surface;

a seat and activity components formed in said base;

a pair of legs, each leg having a longitudinal axis and a wheel;

a boss projecting from each leg;

first and second boss cavities in each of said sides of said base, said boss cavities conforming to an exterior of said bosses, each said first boss cavity having a different angular orientation relative to said longitudinal axis of said leg than each said second boss cavity, said two first boss cavities having the same angular orientation relative to each other and said two second boss cavities having the same angular orientation relative to each other;

wherein said legs are connected to said base by the engagement between said bosses and a selected pair of said first or second boss cavities, the choice of boss cavities determining the angular inclination of said base in either of two positions.

* * * * *